United States Patent [19]

Gagnon

[11] Patent Number: 4,633,234

[45] Date of Patent: Dec. 30, 1986

[54] SONIC DETECTOR HAVING DIGITAL SAMPLING CIRCUIT

[75] Inventor: David G. Gagnon, Warren, Mich.

[73] Assignee: Audio Sentry Manufacturing, Inc., Fraser, Mich.

[21] Appl. No.: 801,380

[22] Filed: Nov. 22, 1985

Related U.S. Application Data

[63] Continuation of Ser. No. 420,179, Sep. 20, 1982, abandoned.

[51] Int. Cl.[4] ..... G08B 13/00

[52] U.S. Cl. ..... 340/566; 340/65; 340/683

[58] Field of Search ..... 340/566, 65, 683

[56] References Cited

U.S. PATENT DOCUMENTS

| | | | |
|---|---|---|---|
| 3,543,261 | 11/1970 | Burney | 340/566 |
| 3,579,220 | 5/1971 | Stevenson, Jr. | 340/566 |
| 3,713,128 | 1/1973 | Wong et al. | 340/566 |
| 3,913,085 | 10/1975 | Farstad | 340/566 |
| 4,081,785 | 3/1978 | Ravis et al. | 340/566 |
| 4,196,423 | 4/1980 | Carver et al. | 340/566 |
| 4,386,343 | 5/1983 | Shively | 340/566 |
| 4,441,103 | 4/1984 | Urabe | 340/683 |

*Primary Examiner*—Glen R. Swann, III

*Attorney, Agent, or Firm*—Krass & Young

[57] ABSTRACT

A sonic detector for security applications or the like includes a digital sampling circuit which converts sound waves into digital pulses and stores the pulses in a counter that is periodically reset by a timing circuit. If a predetermined number of pulses are accumulated in the counter before the counter is reset, an alarm signal is generated to energize an alarm. The duration of the pulses may be altered to compensate for the effects of reflected sound which vary depending on the ambient acoustical environment. The number of pulses required to generate an alarm signal may be preprogrammed in accordance with the type of sounds to be detected. An anti-defeat circuit converts a continuous sound wave to the required number of digital pulses for generating an alarm.

12 Claims, 2 Drawing Figures

SONIC DETECTOR HAVING DIGITAL SAMPLING CIRCUIT

This is a continuation of co-pending application Ser. No. 420,179 filed on Sept. 20, 1982, now abandoned.

DESCRIPTION

1. Technical Field

The present invention generally relates to devices for generating an alarm, and deals more particularly with a circuit for a sound detector or the like which is particularly suitable for security applications.

2. Background Art

Sound detection devices have been employed for several years in security applications where particular types of sound, such as breaking glass announce unauthorized entry into a protected area such as a building. Known prior art sound detectors convert sound waves to electrical signals and include various types of means to analyze the signals in order to distinguish ordinary background noise from those types of sounds more commonly associated with unauthorized entry.

The prior art devices possess a number of shortcomings. One important drawback involves the fact that these devices may be defeated by a continuous sound of constant amplitude and frequency; such a sound source effectively jams the device, thus preventing detection of the sound waves of interest.

Similarly, prior art devices are susceptible to triggering false alarms because of their lack of ability to discriminate between one specific, normal background sound and the sounds intended to be monitored.

False triggering of prior art alarms is also sometimes caused by reflection of sound waves in acoustically hard environments. Prior art sound detection circuits are incapable of protecting against false alarm triggering due to sound reflections.

There is therefore a clear need in the art for an improved sonic detector which eliminates each of the deficiencies discussed above.

SUMMARY OF THE INVENTION

According to the present invention a sonic detector converts sound waves into digital pulses and includes a digital sampling circuit which stores the pulses in a counter. The sampling circuit includes a timer which periodically resets the counter, the interval between successive resets of the counter being a period during which the ambient environment is sampled for abnormal sounds. If a predetermined number of pulses are accumulated in the counter within the sampling period, a one shot pulse generator produces an alarm signal which energizes an alarm, and resets both the counter and timing circuit. The duration of the pulses may be altered to compensate for the effects of reflected sounds, so as to adjust the device for hard or soft acoustical environments. The number of pulses required to generate an alarm signal may be conveniently programmed by means of switches in accordance with the types of sounds to be detected.

BRIEF DESCRIPTION OF THE DRAWINGS

In the drawings, which form an integral part of the specification and are to be read in conjunction therewith, and in which like reference numerals are employed to designate identical components in the various views.

BEST MODE FOR CARRYING OUT THE INVENTION

Figure 1:
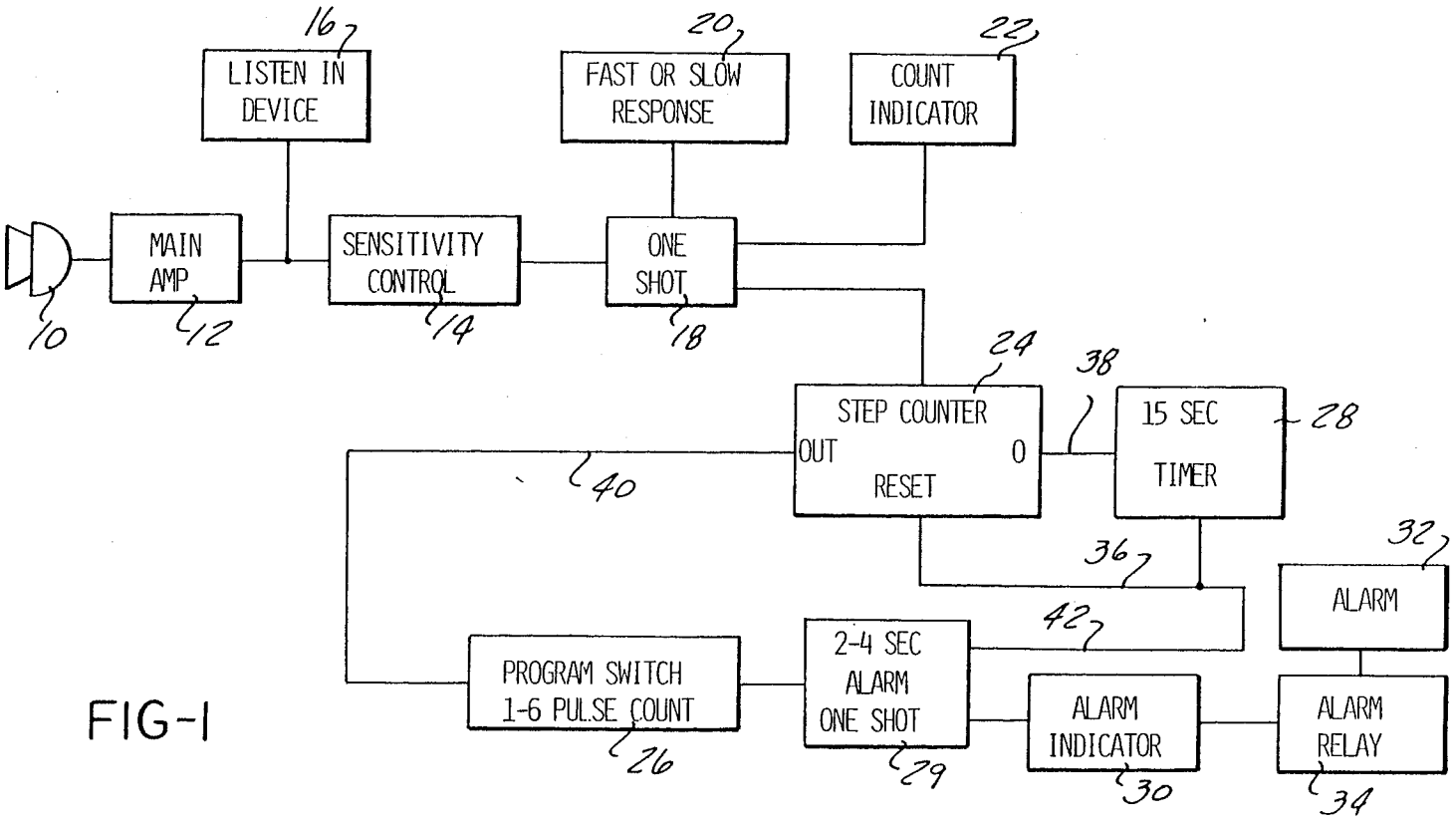
FIG. 1 is a block diagram of the sonic detector which forms the preferred embodiment of the present invention; and, FIG. 2 is a detailed schematic diagram of the circuit for the sonic detector shown in FIG. 1.

Referring first to FIG. 1, the sonic detector of the present invention includes a microphone 10 for receiving sound waves from the surrounding environment and transducing such sound waves into electrical signals. The frequency response of microphone 10 will be selected to pick up the sound waves of interest, and in the case of normal security applications, a ceramic microphone such as the MK-223 (such as made by Audiophonics), which is well known in the art, may be employed.

Electrical signals corresponding to sound waves received by microphone 10 are amplified by conventional audio amplifier 12. A conventional listenin device 16 used in connection with digital telephone dialers or the like may be employed for receiving the amplified audio signals to enable an individual at a remote location to hear the sounds being picked up by microphone 10. In any event, the amplified audio signals are processed by a sensitivity control 14 and are delivered to a digital sampling circuit which includes a one shot pulse generator 18. Sensitivity control 14 determines the amplitude of those sound waves which are further processed. Only sound waves having an amplitude exceeding a prescribed value result in the delivery of corresponding electrical signals to the input of one shot 18. One shot 18 outputs a digital pulse in response to the receipt of each audio signal received from the sensitivity control 14. The duration of the digital pulses output from one shot 18 is controlled by a response switch 20. Response switch 20 effectively regulates the interval between the sound waves which are processed by the sonic detector of the present invention. In the case of relatively hard acoustical environments, a secondary sound wave created by reflection of the primary sound wave may result in the production of a second, false output pulse from one shot 18. By increasing the duration of the first pulse output by one shot 18 resulting from the primary sound wave, the one shot 18 is prevented from producing a second false pulse. A similar timing alteration of the pulses output from one shot 18 is required when the device of the present invention is used in an exceptionally soft acoustical environment. The digital pulse output by one shot 18 is delivered to a count indicator 22 which provides a visual display of each count, and such pulse is also delivered to the input of a step counter 24.

Counter 24 receives and accumulates a count corresponding to the number of digital pulses output by one shot 18. A timer 28 produces a reset pulse at prescribed time intervals on line 36 to the reset input of counter 24, thereby resetting the latter on a periodic basis. Timer 28 is activated by a low signal received on line 38 from counter 24 when counter 24 counts the first pulse produced by one shot 18.

The decoded output lines of counter 24, (indicated in FIG. 1 as a single line 40) are connected through a program switch 26 to the input of a one shot pulse generator 29. Program switch 26, which will be discussed later in more detail, determines the count of 24 at which point an alarm signal is to be produced. When counter 24 reaches the prescribed count within a sampling period determined by timer 28, the one shot 29 delivers a reset signal on line 42 to the reset input of counter 24 and also delivers an alarm pulse to an alarm indicator 30 and thence to an alarm relay 34 which energizes an alarm 32. The alarm indicator 30 may be an audio or visual device providing an indication that an alarm condition has been detected. In the present application, indicator 30 is normally on to allow for circuit supervision and is turned off by the alarm pulse received from one-shot 29, thereby to provide an alarm indication.

Figure 2:
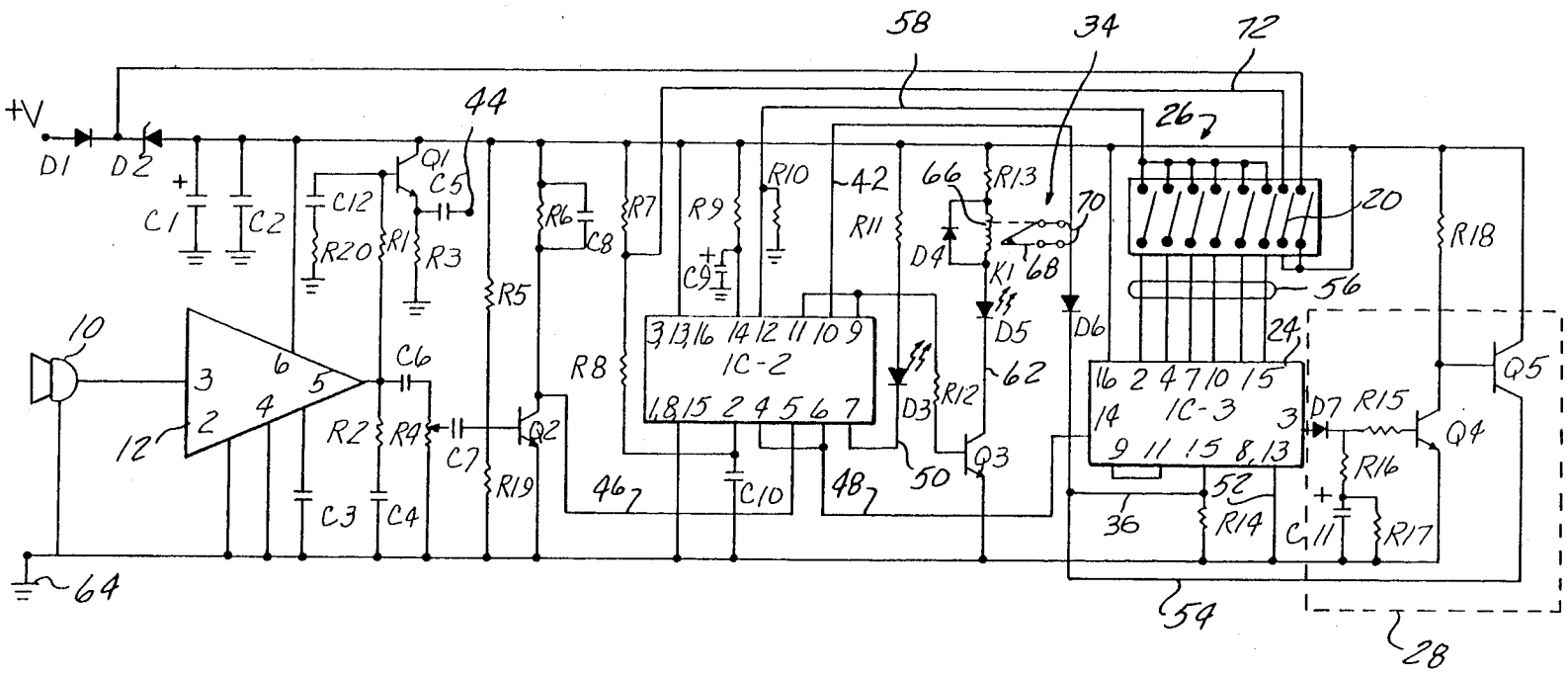

Attention is also now directed to FIG. 2 wherein the schematic diagram for the circuit of the present invention is depicted. The output of microphone 10 is delivered to the input of audio amplifier 12 which may consist of a conventional LM386 chip. The output of amplifier 12 is delivered through resistor R1 to the base of transistor Q1 whose collector to emitter path is coupled between a suitable source of voltage and ground 64 by resistor R3. A conventional "listen-in" device may be connected at terminal 44 which is capacitively coupled via capacitor C5 to the emitter of transistor Q1. It may thus be appreciated that audio signals output from amplifier 12 turn on transistor Q1 to enable the listen-in device 16.

The output of amplifier 12 is also delivered through capacitor C6, variable resistor R4 and capacitor C7 to the base of transistor Q2, the collector-to-emitter path thereof being coupled across a suitable source of voltage. Resistor R4 forms the sensitivity control 14 previously discussed with reference to FIG. 1; the value setting of resistor R4 determines whether the amplitude of the audio signals output from amplifier 12 are sufficient to turn on transistor Q2. Resistor R4 in combination with capacitor C6 and capacitor C7 also define an RC network which produces a series of output pulses to the base of transistor Q2 in response to a constant amplitude, constant frequency output signal from amplifier 12. These latter mentioned components therefore form an anti-defeat circuit which prevents jamming of the detector by a constant sinusoidal input signal exceeding the threshold level of the sensitivity control 14.

Each time transistor Q2 is turned on by an audio pulse output from amplifier 12, a signal is delivered on line 46 to an input (pin 5) of chip IC-2. IC-2 is a conventional chip such as a 4528 which includes a pair of one shot pulse generators corresponding, in the instant circuit, to one shots 18 and 29 shown in FIG. 1. In response to the signal present on line 46, the one shot 18 delivers a digital pulse on line 48 to the clock input (pin 14) of counter 24 (IC-3). Counter 24 may be a conventional decode counter/divider such as a 4017 chip, having 10 decoded outputs, 6 of which outputs are designated by lines 56. One shot 18 also grounds line 50 in order to energize a light emitting diode D3 which is coupled through resistor R11 to the voltage source. It may thus be appreciated that light emitting diode D3 provides a visual indication each time the count of counter 24 is advanced.

Upon receipt of the first pulse on line 48, counter 24 delivers an output pulse from pin 3 thereof to the timer 28 which comprises diode D7, resistors R15, R16, R17, capacitor C11, transistor Q4 and transistor Q5. After a predetermined length of time, for example 15 seconds, capacitor C11 discharges to a level sufficient to reduce the voltage on the base of transistor Q4 until the latter turns off. Turning off transistor Q4 allows transistor Q5 to turn on. With transistor Q5 on, a reset signal is delivered on line 54 and line 36 to the reset input (pin 15), thus resetting the count of counter 24 to "0". When counter 24 is reset, the output hereof on pin 3 goes high, thus charging capacitor C11 to a level sufficient to turn on transistor Q4, thereby causing transistor Q5 to turn off.

During the interval that timer 28 is timing, counter 24 successively counts up pulses received on line 48 which correspond to the number of sound wave "events" which are picked up by microphone 10 and which exceeds the threshold set by sensitivity control 14. The count accumulated in counter 24 is output on lines 56 which are coupled with one side of a series of single throw, single pole switches 26, the other side thereof being commonly connected with line 58. Switches 26 may be programmed so as to deliver a control signal on line 58 to the input of one shot 29 (pin 12 of IC-2) when the count accumulated by counter 24 reaches a prescribed value. If the prescribed count value is reached during the sampling period, i e., before timer 28 times out, the required control signal is delivered on line 58 to one shot 29. If, however, an insufficient number of pulses are counted by counter 24 during the sampling period, timer 28 delivers reset signals on line 54 to reset counter 24 for the next sampling period. In the event that a single continuous sound is detected by microphone 10, the series of electrical pulses produced by capacitors C6, C7 and resistor R4 produce the prescribed count in counter 24 within the sampling period, thus automatically creating an output signal on line 58 which activates the one shot 29.

Triggering of one shot 29 produces a pair of output pulses, one of which on pin 10 of IC2 is delivered via line 42 and line 36 to the reset input (pin 15) of counter 24 thus resetting such counter for the next sampling period. The other output pulse from one shot 28 is produced on pin 11 of IC2 and is delivered through resistor R12 to the base of transistor Q3. The output of pin 11 is normally high; this high signal is delivered to the base of transistor Q3 which renders the collector to emitter path thereof conductive thus allowing current to flow from the positive voltage source through line 62 to ground 64. Current flowing through line 62 results in the illumination of light emitting diode D5, which forms the alarm indicator 30 in FIG. 1, and also flows through the coil 66 of alarm relay 34. In the event of an alarm condition, the output on pin 11 goes low, thereby turning off transistor Q3, which in turn deenergizes relay coil 66 and diode D5. Deenergization of coil 66 causes normally closed contacts 68 to open for a short interval, e.g. one to three seconds. A conventional audio or visual alarm system (not shown) connected to contacts 70 is energized by the opening of contacts 68. By virtue of the fact that diode D5 is in series with the coil 66 and transistor Q3, the continuity of these latter mentioned components is confirmed during circuit supervision. Moreover, the series connection between coil 66 and diode D5 results in minimal current draw (compared to a parallel connection) and diode D5 provides an indication of a fault condition in the event of power failure to the normally energized relay 34.

The fast/slow response switch 20 is coupled between the positive voltage source and line 72 so as to change the bias voltage applied through resistor R8 to the timing input (pin 2 of IC-2) of one shot 18, thereby to change the duration of its output pulse as previously described.

From the foregoing, it is apparent that the sonic detector described above not only provides for the reliable accomplishment of the objects of the invention but does so in a particularly effective and economical manner. It is recognized, of course, that those skilled in the art may make various modifications or additions to the preferred embodiment chosen to illustrate the invention without departing from the spirit and scope of the present contribution of the art. It is also to be noted that although the invention has been described herein in connection with a sonic alarm system, the novel sampling circuit may be employed in other types of alarm apparatus where the alarm condition results in the generation of an alternating type signal having a plurality of recurring signal portions. Accordingly, it is to be understood that the protection sought and to be afforded hereby should be deemed to extend to the subject matter claimed and all equivalents thereof fairly within the scope of the invention.

I claim:

1. An intrusion detection alarm device, comprising:

a microphone;

means for converting the output of said microphone into a plurality of electrical pulses;

means for discretely counting said pulses; and means for producing an alarm when a prescribed number of said pulses have been counted by said counting means.

2. The intrusion detector of claim 1, wherein said converting means includes means for sensing the amplitude of the output of the microphone and for converting to said electrical pulses only those parts of the output having amplitudes exceeding a prescribed value.

3. The intrusion detector of claim 1, wherein said converting means includes:

a pulse generator having an output for delivering an output pulse, and said means for counting includes a counter for receiving and counting output pulses from said pulse generator.

4. The alarm device of claim 1, wherein said producing means includes:

means for producing an alarm signal, an alarm switch responsive to said alarm signal, and means for preventing delivery of said alarm signal to said switch if said prescribed number of pulses are not counted by said counting means within a preselected time period.

5. The alarm device of claim 4, wherein said counting means includes a reset input for resetting the count of said counting means and said preventing means includes a timer and means for delivering a reset signal to said reset input.

6. The alarm device of claim 1, including means for selectively altering the duration of said electrical pulses in accordance with the acoustical characteristics of the ambient environment.

7. An intrusion detection system comprising:

a microphone for converting sound waves into electrical signals;

a first pulse generator for producing electrical pulses in response to said electrical signals;

a counter for discretely counting said electrical pulses;

a second pulse generator for producing an alarm pulse; and programmable means responsive to said counter for enabling said second pulse generator to produce said alarm pulse when the count in said counter reaches a prescribed value.

8. The apparatus of claim 7, including means for resetting the counter after a prescribed time interval that commences with a pulse produced by said first pulse generator.

9. The apparatus of claim 7, including means for visually displaying each count counted by said counter.

10. The apparatus of claim 7, wherein said counter includes a reset input and said second pulse generator includes an output connected with said reset input for resetting said counter after an alarm pulse is generated.

11. A circuit for detecting an intrusion comprising:

a microphone operative to generate an alternating signal;

means for converting the alterations in said signal into a plurality of electrical pulses;

means for discretely counting said pulses; and means for producing an alarm when a prescribed number of said pulses have been counted by said counting means, said producing means including (1) means for producing an alarm signal, (2) an alarm switch responsive to said alarm signal, and (3) means for preventing delivery of said alarm signal to said switch if said prescribed number of pulses are not counted by said counting means within a preselected time interval commencing with a pulse produced by said conversion means.

12. The alarm device of claim 11, wherein said counting means includes a reset input for resetting the count of said counting means and said preventing means includes a timer and means for delivering a reset signal to said reset input.

* * * * *